US005806108A

United States Patent [19]

Mizrahi

[11] Patent Number: 5,806,108

[45] **Date of Patent: *Sep. 15, 1998**

[54] UNIVERSAL REPLACEMENT TOILET TANK

[76] Inventor: Israel Mizrahi, 6614 Noble Ave., Van Nuys, Calif. 91405

[ * ] Notice: The term of this patent shall not extend beyond the expiration date of Pat. No. 5,711,039.

[21] Appl. No.: 782,825

[22] Filed: Jan. 13, 1997

[51] Int. Cl.[6] ..... E03D 1/06

[52] U.S. Cl. ..... 4/344

[58] Field of Search ..... 4/324, 325, 343, 4/344, 353, 378

[56] References Cited

FOREIGN PATENT DOCUMENTS

| | | | |
|---|---|---|---|
| 0448092 | 9/1991 | European Pat. Off. | 4/324 |
| 2415171 | 9/1979 | France | 4/353 |
| 2205531 | 8/1973 | German Dem. Rep. | 4/343 |
| 4303343 | 8/1994 | Germany | 4/353 |
| 0023210 | of 1897 | United Kingdom | 4/344 |

*Primary Examiner*—Charles E. Phillips

*Attorney, Agent, or Firm*—Albert O. Cota

[57] ABSTRACT

A universal replacement toilet tank (10) that incorporates within a toilet tank (12) a piston flush valve (40) that functions in combination with a ballcock (22), a water closet (30) and a pressure increasing riser (120). The valve (40) is designed to be easily adjusted to allow a selected volume of flush water to flow from the toilet tank (12) into the water closet (30). The pressure increasing riser (120) consists of a hollow pipe (122) and a decorative sleeve (140) that are positioned between the toilet tank (12) and the water closet (30). The riser allows the toilet tank (12) to be elevated above the water closet (30) to provide an increase in the pressure of the water that is used to flush the water closet (30). The invention also includes a threaded adapter (100) having upward internal threads (102) and downward external threads (104). The internal threads (102) are threaded into the threaded section (96) on the flush valve attachment structure (84) and the external threads (104) are inserted through a water egress port (24) on the toilet tank (12). The adapter allows the universal replacement toilet tank (10) to be used with various designs of water closets (30).

15 Claims, 3 Drawing Sheets

UNIVERSAL REPLACEMENT TOILET TANK

TECHNICAL FIELD

The invention pertains in general to toilets which include a water closet and a toilet tank that incorporates a flush valve and a ballcock. More particularly, the invention pertains to a toilet tank that utilizes, in combination, a piston flush valve, a ballcock, a threaded adapter, a pressure increasing riser and a tank stabilization bracket.

BACKGROUND ART

The modern toilet consists of three parts, (1) a toilet tank which functions as a water reservoir, (2) a water closet consisting of a bowl that also contains a volume of water into which is introduced human waste products and (3) a flushing apparatus.

After waste products have been introduced into the water closet, they are flushed by activating the flushing apparatus which allows the water held in the toilet tank to flow into and flush the toilet bowl. The flushed waste products are routed into a collection system, such as a sewer system or septic tank, after which the toilet tank and water closet are refilled with water in preparation for a subsequent flush.

Waste products consist of solid and liquid waste and a single flush is normally utilized to carry away both the solid and the liquid waste.

One of the most popular toilet flushing apparatuses in use today, includes a ballcock valve assembly that controls the inlet of water into the toilet tank. A buoyant float ball is connected to the ballcock by means of a float arm. As the toilet tank fills with water, the buoyant float ball rises. The upward motion of the float ball is transmitted to the ballcock through the float arm until at a predetermined water level, the ballcock shuts off the water inlet to the toilet tank. In most toilets, the water level in the water tank may be adjusted by means of a screw-set mechanism located in the ballcock assembly. Once the water level in the tank is set, the adjustment is no longer required. The same volume of water is therefore discharged every time the toilet tank is flushed.

It is well known fact that the largest use of water in most households and in many office buildings is for flushing toilets. Because the flushing is carried out with the full capacity of the water in the water tank, the water usage is wasteful and not required. Considerable interest has been centered on reducing the water used when toilets are flushed, especially at times and in places when there is a water deficiency or periods of drought.

Several water saving methods are in current use to conserve water during the toilet flushing operation. One such method is to place 8 filled water bag or a solid object, such as a brick, in the water tank to displace an equivalent volume of water to thus reduce the volume of water consumed with each flushing. Another common method is to lower the float valve to allow the ballcock to close at a reduced water level. These methods to conserve water in many cases are self-defeating, in that, the effectiveness of the partial flush is diminished, because it may be necessary to flush twice to effect a sanitary flush. Additionally, such methods represent a compromise in that once the Volume of water is set, it is not readily adjustable.

In summary, the design of the prior art flushing apparatuses with respect to the design of the instant invention are relatively complicated, are difficult to adjust the water level and are relatively not as reliable and as maintenance free as the modified piston flush valve used with the instant invention. Additionally, the instant invention functions in combination with a pressure increasing riser. This riser allows the toilet tank to be elevated to substantially increase the water pressure applied to the water closet.

A search of the prior art did not disclose any patents that read directly on the combination of elements utilized with the instant invention and on the claims of the instant invention.

DISCLOSURE OF THE INVENTION

At the present time, conservation of our natural resources should have everyone's prime consideration. Water is a basic human need and in some areas of the world it is in short supply especially during specific seasons. Further, water may be expensive and often considerable amounts are wasted for sanitation purposes which includes the disposition of human waste. The conventional methods employed domestically are the utilization of toilet, that include a vitreous china water closet and a toilet tank directly coupled thereupon, water is released from the toilet tank and is flushed into the water closet under minimal pressure to clear the bowl in the closet. A ballcock valve with a float refills the tank for subsequent flushing.

The industry is aware of the problem of water conservation and is now producing toilets that function properly with as little as a 1.6 gallons (5.9 liters) of water per flush.

The universal replacement toilet tank functions in combination with a water closet and five inventive elements: a modified piston flush valve, a flush valve attachment structure, a threaded adapter, a pressure increasing riser and a toilet tank stabilization bracket.

The piston flush valve used with the invention was developed in Israel, by a company known as Plasson, however, its functional operation is directed to European standards and is not readily applicable to equipment presently in use in the United States of America without some modification. Therefore, the valve must be modified to be compatible with the toilets presently in public use in the United States. The Plasson company valve utilizes dual flush handles and lever arms. One arm pulls up a vertical tube for limited flushing and the other arm pulls up both the vertical tube and an ancillary float assist that extends the opening time until the entire water volume in the toilet tank is depleted. Further, a refill tube bracket must be added to allow a refill tube to be attached, and an overflow opening is added to meet applicable domestic codes which place the overflow level 1.25 inches (3.2 cm) below the diaphragm of the ballcock. Additionally, since many toilets in use abroad are flat and thin, a beveled washer must be fitted at the lower threaded end of the valve to mate with the vitreous china toilet tanks used in this country.

The piston flush valve features a float that is easily positioned to allow the volume of water that is applied to the toilet bowl to be selected. Typically, the float is positioned to allow 1.6 gallons (5.9 liters) to flush the toilet bowl. The flush valve is attached to the toilet tank by means of the flush valve attachment structure. The upper end of this structure is threaded into the lower end of the piston flush valve and the opposite lower end, which is also threaded, is used to attach the flush valve to the water closet. In some locations, in order to attach the valve, a different thread size is required. To solve this problem a threaded adapter having upper internal threads and lower external threads is utilized. The internal threads are designed to be threaded into the threads on the flush valve attachment structure and the lower outward extending threads are then used to attach the valve to the water closet.

The pressure increasing riser and the toilet tank stabilizing bracket are located external to the toilet tank.

The pressure increasing riser consists of a hollow tube that is attached between the toilet tank and the water closet. The riser increases the pressure of the water and also the velocity with which it enters into the closet bowl. The addition of 12 inches (30.5 cm) increases the pressure by 0.43 pounds per square inch (2.98 Kpag), which is sufficient to easily empty the bowl with only one gallon of water per flush. This riser requires an attaching plate that adapts the riser to various sizes of water closets. The toilet tank stabilization bracket provides a means for positively and safely securing the toilet tank to a building wall.

In view of the above disclosure, it is the primary object of the invention to provide a universal replacement toilet tank that can be used with various water closet designs and that uses a pressure increasing riser which substantially increases the flush water pressure.

In addition to the primary object it is also an object of the invention to provide a universal replacement toilet tank that:

- although the invention is primarily designed as a replacement tank, the design is also amendable for use by original equipment manufacturers (OEM),
- utilizes a modified piston flush valve that is easily adjusted to provide a selected volume of flush water,
- uses a pressure increasing riser that can also be independently used in other water saving toilets to increase the water pressure,
- is reliable and easily maintained, and
- is cost effective from both a manufacturing and consumer points of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
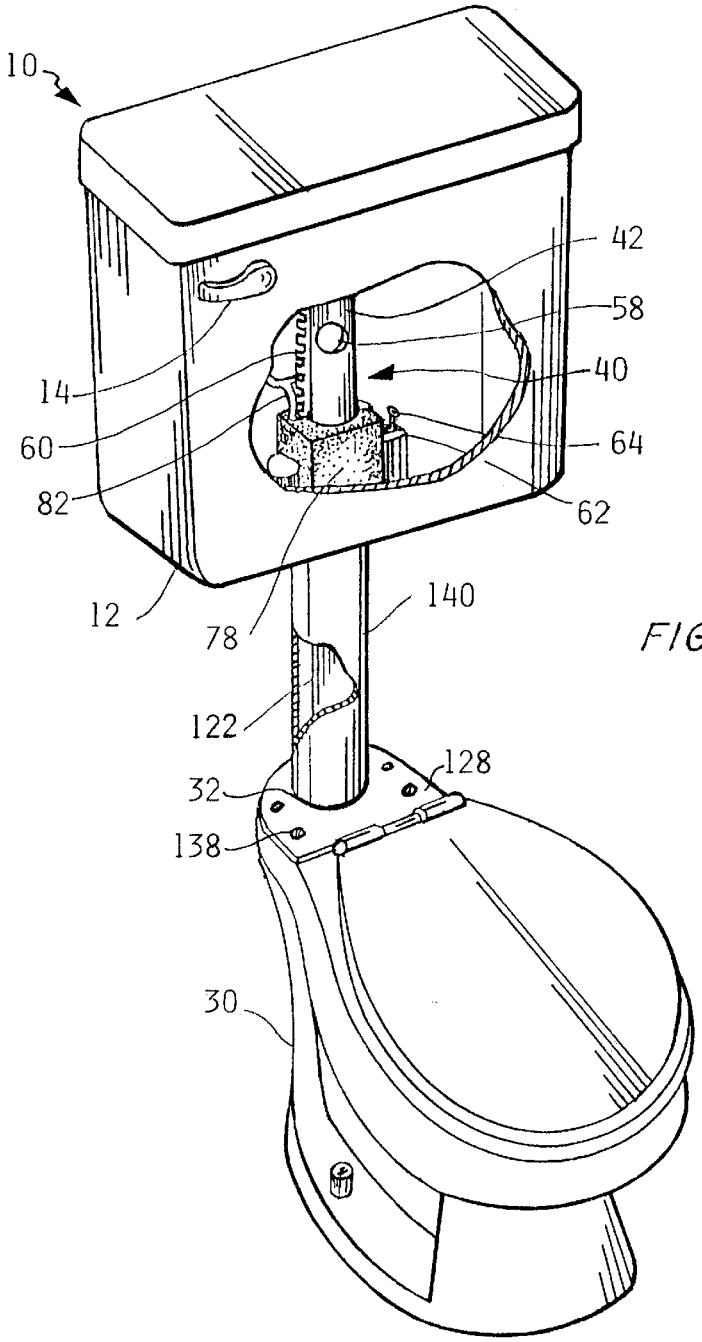
FIG. 1 is an isometric view of the preferred embodiment partially cutaway to illustrate the positioning of the piston flush valve and the pressure increasing riser.

The best mode for carrying out the universal replacement toilet tank 10 is presented in terms of a preferred embodiment which allows the tank 10 to be used with various designs and sizes of water closets, The preferred embodiment, as shown in FIGS. 1–12 is comprised of the following major elements: a toilet tank 12 that includes a flush handle 14 that has attached a trip lever 16, a ballcock 22, a water egress port 24 and an improved piston flush valve 40. The toilet tank 12 functions in combination with a pressure increasing riser 120, a toilet tank stabilizing bracket 144 and a water closet 30 that includes a water ingress port 32.

Figure 3:
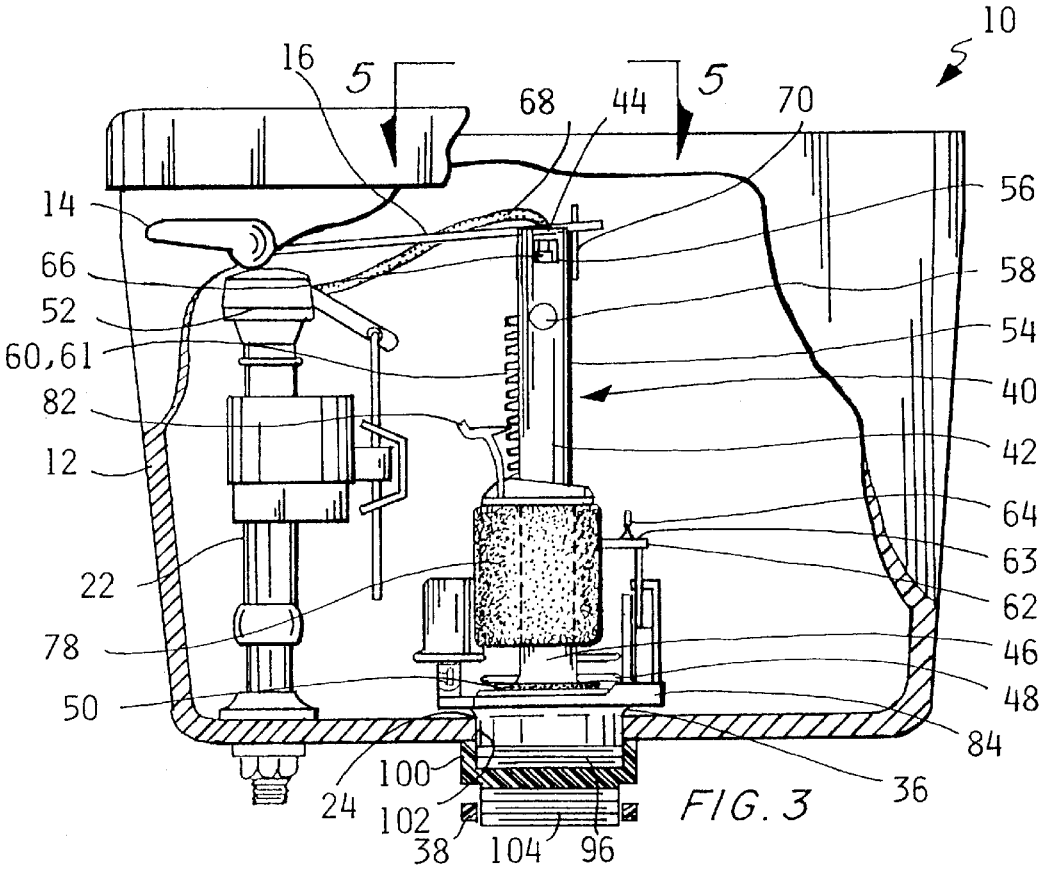
FIG. 3 is a partial isometric view of the toilet tank cutaway to illustrate the internal elements.

The improved piston flush valve 40 is installed within the water tank 12 in a conventional manner, using a resilient beveled washer 36 and a locknut 38 as shown in FIG. 3. The original, unimproved valve is manufactured in Israel by the Plasson company and is preferably constructed of a thermoplastic.

Figure 5:
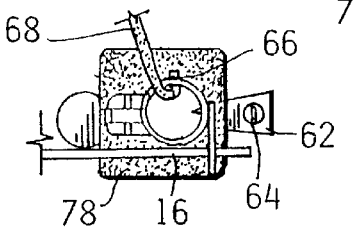
FIG. 5 is a top plan View of the piston flush valve taken along the lines 5—5 of FIG. 3.
Figure 4:
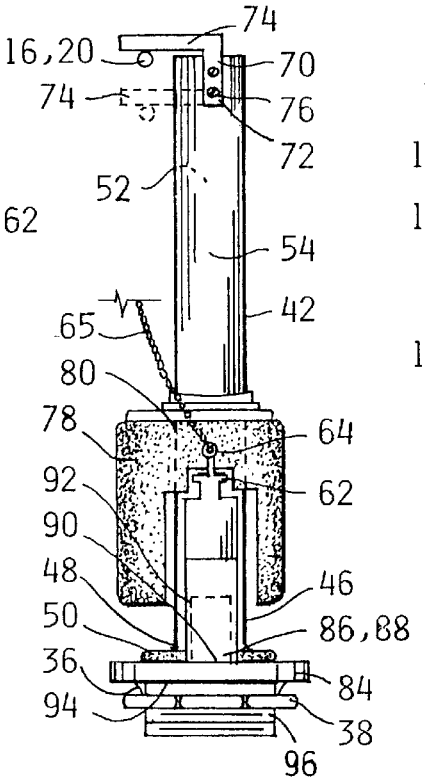
FIG. 4 is an elevational view of the piston flush valve as seen from the right side and completely removed from the toilet tank for clarity.

The improved piston flush valve 40 as shown in FIGS. 3, 4 and 5 consists of a vertical tube 42 having an upper end 44 and a lower end 46. The lower end is further comprised of a valve-washer retaining section 48 which consists of two retaining rings. Between the two rings is inserted and retained a replaceable valve washer 50. The vertical tube 42 also has a first side 52, a second side 54, and a side opening 56 and an overflow opening 58 both of which are located near the upper end 44 of the tube 42.

Along the first side 52 is integrally located a vertically notched section 60 that functions with a spring clip 82 as described infra; and from the second side 54, above the lower end 46, is a horizontal protrusion 62 to which is attached a pull-chain eyelet 64 as also described infra. To the side opening 56 is clipped a refill tube bracket 66 and to the bracket is attached one end of a refill tube 68 that has its other end inserted into the upper end of the ballcock 22 as shown in FIG. 3.

To the second side 54 near the upper end 44 is attached a trip lever bracket 70. As shown best in FIG. 4, the trip lever bracket 70 is in an "L" configuration that is comprised of a vertical section 72 and an integral horizontal section 74. The vertical section 72 is attached to the second side 54 of the vertical tube 42 by an attachment means which preferably consists of a pair of screws 76 as best shown in FIG. 4. When 50 attached, the horizontal section 74 protrudes outward from the upper end 44 of the vertical section 42 to interface with the outward side 20 of the trip lever arm 16 as shown in FIG. 4. When the flush handle 14 is manually depressed, the trip lever arm 16 lifts the vertical tube 42 causing the water in the toilet tank 12 to flow into and flush the water closet 30. As shown by the broken lines in FIG. 4, the vertical section 72 can be disposed 180° to allow the horizontal section 74 to protrude outwardly from a lower portion of the vertical section 72.

The piston flush valve 40 also includes a float 78 and a flush valve attachment structure 84.

Figure 7:
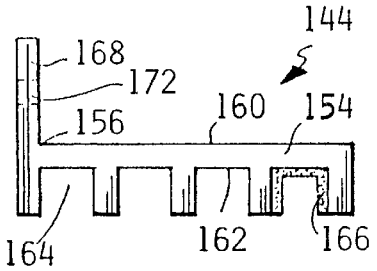
FIG. 7 is a side elevational view of a tank stabilizing bracket.

The float 78, as also shown in FIGS. 7 and 4, is preferably constructed of polyurathane and includes a vertical bore 80 that is dimensioned to slidably fit over the vertical tube 42. On the side of the float 78, that interfaces with the vertical notched section 60, is located a spring clip 82. The clip is designed to be selectively inserted into one of the notches on the vertically notched section 60 to allow the float 78 to remain in a selectable vertical position. When the spring clip 82 is inserted into the fourth notch 61 from the top of the notched section 60, a water volume of 1.6 gallons (5.9 liters) is flushed. By moving the spring clip upward the float 78 is positioned so that less than 1.6 gallons of water is flushed conversely, if the spring clip is moved downward more than 1.6 gallons of water is flushed.

The flush valve attachment structure 84, as shown in FIGS. 3 and 4, has a center section 86 with an opening 88. Across this opening, is integrally located a horizontal support section 90 from where extends upward a vertical section 92 that is shaped to slidably fit into the lower end 46 of the vertical tube 42. From the lower outward side 94 extends downward a threaded section 96 that is dimensioned to be slidably inserted into the water egress port 24 on the toilet tank 12. After the threaded section is inserted, the washer 36 is inserted and the locknut 38 is threaded into the threaded section 96 to affix the flush valve 40 to the toilet tank 12.

In many countries, the threaded section 96 is not correctly dimensioned to properly install the piston flush valve 40. To preclude this problem, a threaded adapter 100, as shown installed in FIG. 3, is utilized. This adapter, has upward internal threads 102 and downward external threads 104. The internal threads 102 are machined to be threaded into the threaded section 96 on the flush valve attachment structure 84.

Two other design improvements are incorporated into the design of the vertical tube 42. These are the pull-chain eyelet 64 and the vertical tube extender 106.

The pull-chain eyelet 64 is attached to an upper surface 63 of the horizontal protrusion 62 as shown in FIGS. 3 and 4. The eyelet 64 allows a pull-chain 65 to be attached between the eyelet 64 and the trip lever arm 16 that extends from the flush handle 14.

Figure 6:
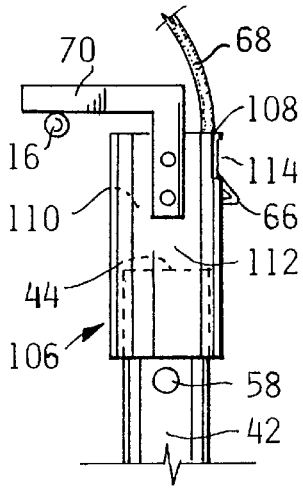
FIG. 6 is an elevational side view of the vertical tube extender.

The vertical tube extender 106 as shown in FIG. 6 has an inside diameter that is dimensioned to allow the extender 106 to be inserted over the upper end 44 of the vertical tube 42. The extender 106 has an upper end 108, a first side 110, a second side 112 and a side opening 114. To the second side 112, near the upper end 108 is attached the trip lever bracket 70 and a refill tube bracket 66 is clipped to the side opening 114. The vertical tube extender 106 is used with toilet tanks 12 that have a higher vertical height than conventional toilet tanks 12.

Figure 2:
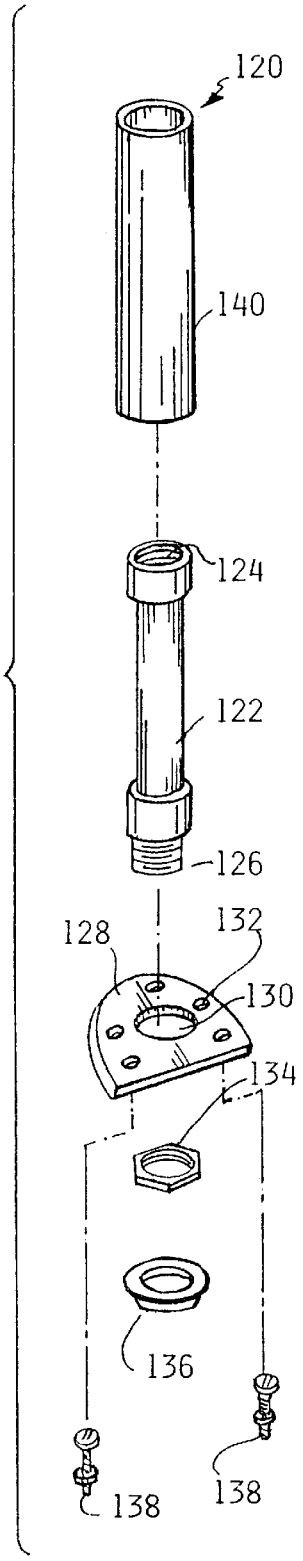
FIG. 2 is an exploded view of the pressure increasing riser.

The final element used with the universal replacement toilet tank 10 is the pressure increasing riser 120. The riser 120, as shown in an exploded view in FIG. 2, is installed between the water closet 30 and the toilet tank 12 as shown in FIG. 1 and is designed to increase the water pressure for flushing water into the water closet 30 from the toilet tank 12.

The pressure increasing riser 120 which may also be employed independently as a feature on other water saving toilets, consists of a hollow pipe 122 with internal threads 124 on a first end and external threads 126 on a second end. The pipe 122 may be constructed of metal or preferably of polyvinyl chloride (PVC) Schedule 40. It is preferably 12 inches (30.5 cm) in height however, from 6 inches (15.3 cm) to 18 inches (45.7 cm) is acceptable in this application.

An attaching plate 128 having an opening 130 therethrough, receives the second end of the hollow pipe 122 and contains a plurality of bores 132 for connecting to commercially available water closets 30. The plate 128 may be made of any material such as plated steel, stainless steel, or a thermoplastic. The plate 128 may be any size and shape to match specific water closet manufacturer's specifications or may be universal with additional bores added to interface with a number of different water closet configurations.

A closet spud 134 threadably engages the second end of the hollow pipe 122 to retain the plate 128 inbetween and allow attachment. A resilient tapered gasket 136 is slipped over the second end of the hollow pipe 122 to hermetically seal the pipe 122 to the water closet 30. A number of threaded closet fasteners 138 penetrate the bores 132 in the plate 128 and water closet 30 compressing the gasket 130 and physically mounting the plate 128 to the water closet 30.

The first end of the pipe 122 is threadably screwed into the threaded section 96 of the flush valve attachment structure 84 completing the closure and watertight seal. A decorative cover sleeve 140 is preferably placed over the hollow pipe 122 to conceal its utilitarian appearance and add aesthetic value to the pressure increasing riser 120. The pipe is typically in the same color as the toilet tank 12 and water closet 30.

To complete the attachment of the toilet tank 12, a tank stabilization bracket 144 is utilized that stabilizes the toilet tank 12 against a building wall 146. The bracket 144 as shown in FIGS. 7–12, functions in combination with the toilet tank 12 as shown in FIG. 9 that includes a rear wall 148 with an upper edge 150 further having a bracket notch 152.

Figure 10:
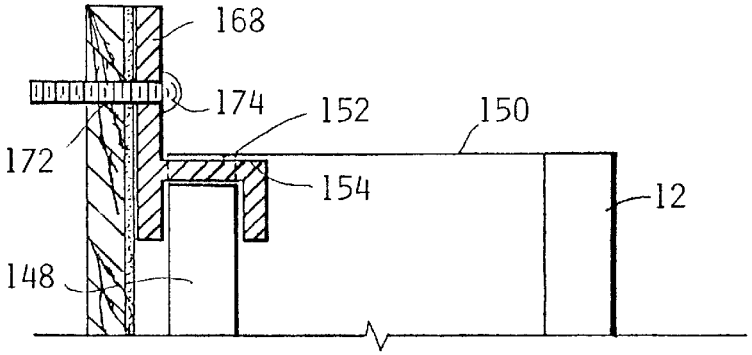
Figure 11:
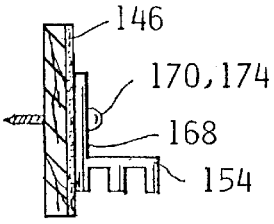
FIG. 11 is a partial elevational view showing the vertical section of the bracket attached to a wall by means of a screw.

The tank stabilization bracket 144 is comprised of a horizontal section 154 having a rear edge 156, a front edge 158, an upper surface 160 and a lower surface 162. From the lower surface 162 extend downward a plurality of longitudinal channels 164 that can range between two and five. The channels 164 are sized to be placed over the bracket notch 152, so that the bracket's horizontal section 154 is substantially flush with the upper edge 150 of the toilet tank 12 as shown in FIG. 10, thus, allowing the tank tank cover (not shown) to be placed upon a planar surface. To soften the contact surface of the channels 164 with the toilet tank 12, a resilient pad 166 as shown in FIG. 7, is inserted into and attached to the particular channel 164 that is to be placed over the bracket notch 152.

Figure 8:
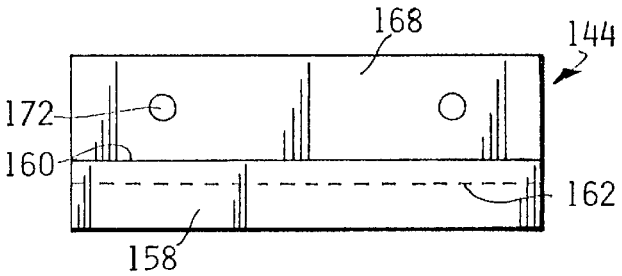
FIG. 8 is a front elevational view of the tank stabilizing bracket.
Figure 9:
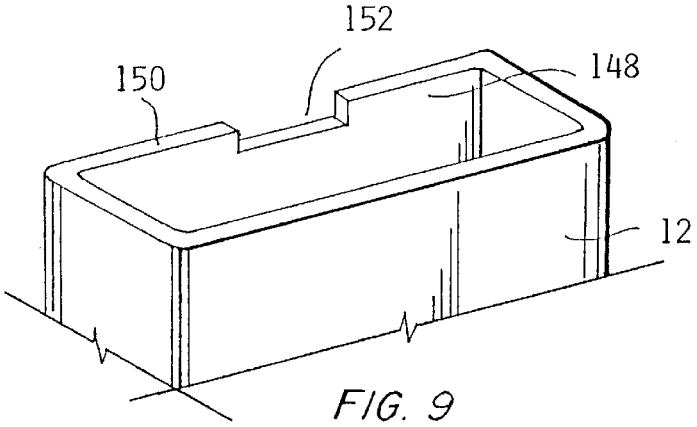
FIG. 9 is a perspective view of a toilet tank having a bracket notch cut into the edge of the rear FIG. 10 a sectional view showing the toilet tank stabilization bracket placed over the bracket notch on the toilet tank.
Figure 12:
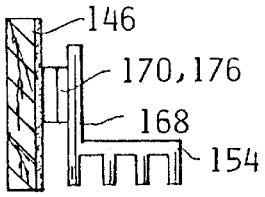
FIG. 12 is a partial elevational view showing the vertical section of the bracket attached to a wall by means of hook and loop fasteners.

Extending upward and normal from the rear edge 156 of the horizontal section 154 is a vertical section 168 as also shown best in FIGS. 7 and 8. This section has an attachment means 170 that allows it to be easily attached to a building wall 146. The attachment means 170 preferably consists of a vertical section 168 having at least two bores 172 therethrough as shown in FIG. 8. Through each of these bores 172 and into the building wall 146 is inserted a screw 174. Alternatively, as shown in FIG. 12, the attachment means 170 may consist of a hook and loop strip 176, sold under the VELCRO® trademark. In this method, a strip 176 is attached respectfully to the building wall 146 and the vertical section 168.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A universal replacement toilet tank that functions in combination with a water closet, wherein said universal replacement toilet tank comprises:

A. a piston flush valve comprising:

a) a vertical tube having:

(1) an upper end, a lower end consisting of a valve-washer section which retains a replaceable valve washer, a first side, a second side, a side opening located near the upper end, a vertically notched section located along the first side, and a horizontal protrusion extending from the second side above the lower end, (2) a refill tube bracket clipped to said side opening, (3) a trip lever bracket attached to the second side near the upper end, b) a refill tube having one end attached to said refill tube bracket and the other end inserted into a ballcock located within said toilet tank, c) a float having a vertical bore dimensioned to slidably fit into said vertical tube, said float having a spring clip designed to be selectively inserted into one of the notches on said vertically notched section to allow said float to be placed in a selectable vertical position corresponding to the volume of water that is to flow down from said toilet tank into said water closet, d) a flush valve attachment structure having a center section having an opening that includes a horizontal support section from where extends upward a vertical section that is shaped to slidably fit into the lower end of said vertical tube and wherein from the lower outward side of the center section extends downward a threaded section dimensioned to be slidably inserted into an egress port located on said toilet tank, e) a locknut designed to be threaded into the threaded section on said flush valve attachment structure, f) a trip lever arm having an inward side attached to a flush handle located on said toilet tank and an outward side that interfaces with the lever bracket, whereupon when said flush handle is manually depressed, the trip lever arm lifts said vertical tube causing the water in said toilet tank to flow out of an egress port on said toilet tank and flow into and flush said water closet, and B. a pressure increasing riser positioned between said water closet and said toilet tank, wherein said riser increases the water pressure for flushing water into said water closet from said toilet tank said riser comprising:

a) a hollow pipe having female threads on a first end and male threads on a second end, b) an attaching plate having an opening to receive the second end of said hollow pipe and a plurality of bores for connecting to commercially available water closets, c) a closet spud to threadably engage the second end of said hollow pipe and retain said attaching plate therebetween, d) a resilient tapered gasket disposed upon the second end of said hollow pip to hermetically seal said pipe to said water closet, e) a plurality of water closet fasteners to affix said attaching plate to said water closet and compress the gasket into said water closet, and f) said first end of said hollow pipe threadably engaged into said modified flush valve.

2. The universal replacement toilet tank as specified in claim 1 wherein said float is constructed of polyurathane.

3. The universal replacement toilet tank as specified in claim 1 wherein said flush lever bracket is comprised of a vertical section and an integral horizontal section, wherein the vertical section is attached to the second side of said vertical tube by an attachment means and the horizontal section protrudes outward from the upper end of the vertical section to interface with the trip lever.

4. A universal replacement toilet tank as specified in claim 3 wherein the vertical section is rotated 180° to allow the horizontal section to protrude outward from the lower end of the vertical section.

5. The universal replacement toilet tank as specified in claim 1 further comprising a pull-chain eyelet attached to an upper surface of the horizontal protrusion on said vertical tube, wherein said eyelet allows a pull-chain to be attached between said eyelet and the trip lever extending from said flush handle.

6. The universal replacement toilet tank as specified in claim 1 further comprising a threaded adapter having upward internal threads and downward external threads, wherein the internal threads are machined to be threaded into the downward threaded section on said flush valve attachment structure and the external threads are dimensioned to be slidably inserted into the water egress port on said toilet tank.

7. The universal replacement toilet tank as specified in claim 1 further comprising a vertical tube extender having an inside diameter dimensioned to allow said extender to be inserted over the upper end of said vertical tube, wherein said extender having an upper end, a first side, a second side, a side opening, and a vertically notched section located along the first side, wherein said trip lever bracket is attached to the second side near the upper end, and said refill tube bracket is inserted in to the side opening.

8. The universal replacement toilet tank as specified in claim 1 wherein said pressure increasing riser further comprises:

a) a hollow pipe having internal threads on a first end and external threads on a second end, b) an attaching plate having an opening to receive the second end of said hollow pipe and a plurality of bores for connecting to commercially available water closets, c) a closet spud to threadably engage the second end of said hollow pipe and retain said attaching plate therebetween, d) a resilient tapered gasket disposed upon the second end of said hollow pipe to hermetically seal said pipe to said water e) a plurality of water closet fasteners to affix said attaching plate to said water closet and compress the gasket into said water closet and, f) said first end of said hollow pipe threadably engaged into said flush valve.

9. The universal replacement toilet tank as specified in claim 8 further comprising a decorative cover sleeve placed over said hollow pipe to conceal its appearance.

10. The universal replacement toilet tank as specified in claim 1 further comprising a toilet tank stabilizing bracket that functions in combination with said toilet tank having a rear wall with an upper edge further having a bracket notch, said toilet tank stabilizing bracket comprising:

a) a horizontal section having a rear edge, a front edge, an upper surface and a lower surface, with said lower surface having a plurality of longitudinal channels that are sized to be placed over said bracket notch, wherein when said bracket is attached, the horizontal section of said bracket is flush with the upper edge of said toilet tank, and b) a vertical section extending upward and normal to the rear edge of said horizontal section, and having means for being attached to a building wall adjacent to said toilet tank.

11. The universal replacement toilet tank as specified in claim 10 wherein said plurality of longitudinal channels ranges between two and five.

12. The universal replacement toilet tank as specified in claim 11 wherein said means for attaching said vertical section to the building wall comprises a hook and loop fastener attached respectfully to said building wall and the vertical section of said toilet tank stabilizing bracket.

13. The universal replacement toilet tank as specified in claim 11 wherein said tank stabilizing bracket further comprises a resilient pad that is inserted into and attached to the longitudinal channel that is placed over said bracket notch.

14. The universal replacement toilet tank as specified in claim 11 wherein said means for attaching said vertical section to the building wall comprises:

a) said vertical section having at least two bores therethrough, and b) at least two screws that are inserted through said bores and into the building.

15. A universal replacement toilet tank that functions in combination with a water closet wherein said toilet tank includes a piston flush valve comprising:

a) a vertical tube having an upper end, a lower end consisting of a valve-washer section which retains a replaceable valve washer, a first side, a second side, a side opening located near the upper end, a vertically notched section located along the first side, and a horizontal protrusion extending from the second side above the lower end, b) a refill tube bracket clipped to said side opening, c) a refill tube having one end attached to said refill tube bracket and the other end inserted into a ballcock located within said toilet tank, d) a trip lever bracket attached to the second side near the upper end, e) a float having a vertical bore dimensioned to slidably fit into said vertical tube, said float having a spring clip designed to be selectively inserted into one of the notches on said vertically notched section to allow said float to be placed in a selectable vertical position corresponding to the volume of water that is to flow down from said toilet tank into said water closet, f) a flush valve attachment structure having a center section having an opening that includes a horizontal support section from where extends upward a vertical section that is shaped to slidably fit into the lower end of said vertical tube and wherein from the lower outward side of the center section extends downward a threaded section dimensioned to be slidably inserted into the water egress port, g) a locknut designed to be threaded into the threaded section on said flush valve attachment structure, and h) a trip lever arm having an inward side attached to a flush handle located on said toilet tank and an outward side that interfaces with the lever bracket, whereupon when said flush handle is manually depressed, the trip lever arm lifts said vertical tube causing the water in said toilet tank to flow out of an egress port on said toilet tank and flow into and flush said water closet, said riser comprising:

a) a hollow pipe having female threads on a first end and male threads on a second end, b) an attaching plate having an opening to receive the second end of said hollow pipe and a plurality of bores for connecting to commercially available water closets, c) a closet spud to threadably engage the second end of said hollow pipe and retain said attaching plate therebetween, d) a resilient tapered gasket disposed upon the second end of said hollow pip to hermetically seal said pipe to said water closet, e) a plurality of water closet fasteners to affix said attaching plate to said water closet and compress the gasket into said water closet, and f) said first end of said hollow pipe threadably engaged into said modified flush valve.

* * * * *